United States Patent [19]

Brown, Jr.

[11] 4,400,026

[45] Aug. 23, 1983

[54] TILT LATCH FOR WINDOW SASH

[75] Inventor: John M. Brown, Jr., Brentwood, Tenn.

[73] Assignee: Alcan Aluminum Corporation, Cleveland, Ohio

[21] Appl. No.: 193,308

[22] Filed: Oct. 2, 1980

[51] Int. Cl.[3] ..... E05C 1/04

[52] U.S. Cl. ..... 292/175; 292/152; 292/DIG. 47; 292/DIG. 38

[58] Field of Search ..... 292/175, 145, 152, DIG. 38, 292/DIG. 53, DIG. 47; 447/181

[56] References Cited

U.S. PATENT DOCUMENTS

| | | | |
|---|---|---|---|
| 1,601,482 | 9/1926 | Sutherland | 292/145 |
| 1,862,757 | 6/1932 | Menns | 49/181 |
| 1,909,964 | 5/1933 | Ingham | 292/337 X |
| 2,620,213 | 12/1952 | Keeler | 292/152 X |
| 3,671,065 | 6/1972 | Bingham | 292/175 |

*Primary Examiner*—Richard E. Moore

*Attorney, Agent, or Firm*—Cooper, Dunham, Clark, Griffin & Moran

[57] ABSTRACT

A tilt latch for a window sash including a base member mountable on a sash and a slide member disposed for sliding movement in a channel formed in the base member and resiliently biased toward an extended position in which a nose-shaped first end of the slide member engages a window frame to prevent the sash from tilting out of the frame. A downward projection formed on a second end portion of the slide member interferingly engages an end edge of the base member to arrest movement of the slide member at the extended position, but this second end portion of the slide member is dimensioned to enable the projection to be lifted manually out of such engagement so that the slide member can be moved beyond the extended position.

7 Claims, 8 Drawing Figures

16
5
20
22
10
12
14
11
18
19
28
78
26
34
80
82
72
32
75
64
68
60
76
62
66a
70
74
52
58
50
66b
54
48
30
56

TILT LATCH FOR WINDOW SASH

DESCRIPTION

BACKGROUND OF THE INVENTION

This invention relates to window assemblies having tiltable sashes, and more particularly to a new and improved form of tilt latch for releasably retaining a tiltable window sash in a window frame.

Windows having sashes that slide vertically in fixed frames are sometimes arranged to enable the sash to rotate or tilt inwardly (about an axis generally coincident with the bottom rail of the sash), for example to facilitate cleaning the outside glass surface of the window. To this end, the sash is typically provided with a pair of latches, mounted at the top of the sash respectively adjacent the sides thereof, and designed to ride in vertical recesses formed in the two sides of the frame so as to retain the sash in its path of sliding movement in the frame, the latches being manually disengageable from the frame recesses to release the sash for tilting with respect to the frame.

Latches having the above-described function (commonly termed tilt latches) are conventionally constituted of two injection-molded plastic parts and a resilient biasing element such as a spring. Thus, an illustrative conventional tilt latch includes a base member mountable on the top corner of the window sash, a slide member disposed in the base member for sliding movement into and out of a position in which it is inserted in a window frame recess, and a coil spring for biasing the latch member into the inserted position while permitting the slide member to be moved manually against the spring force to a retracted position in which the slide member is clear of the window frame.

Various difficulties have heretofore been encountered with conventional tilt latches of the type described. For instance, it has been necessary for the installer to asssemble the latch components before mounting the latch on a window sash. This is not only inconvenient for the installer but may lead to loss of or damage to parts of the latch assembly. In addition, known latches have been undesirably large in size, and the location of fasteners for securing such latches to a window sash has been dictated by considerations of latch design which have prevented attainment of optimum strength or security of attachment.

SUMMARY OF THE INVENTION

The present invention broadly contemplates the provision of a tilt latch of the above-described general type, comprising a base member mountable on a sash, a slide member carried by the base member for endwise sliding movement relative thereto, and resilient biasing means such as a coil spring acting between the base member and the slide member. The base member has a bottom with an upwardly facing surface and opposed first and second end edges, and spaced parallel sides projecting upwardly from the bottom to define therewith an upwardly opening, open-ended channel, facing parallel grooves being respectively formed in the sides. The slide member, disposed in the channel of the base member, has opposed first and second ends respectively adjacent the first and second end edges of the base member bottom, and opposed side flanges extending from the first end toward the second end and respectively received in the aforementioned grooves, the slide member further having, at its first end, a nose receivable in a window frame to prevent tilting of the sash (on which the latch is mounted) relative to the frame. The resilient biasing means urges the slide member in a locking direction, viz. toward an extended position in which the nose of the slide member projects beyond the first end of the base member so as to be received in the window frame.

In accordance with the invention, and as a particular feature thereof, the slide member includes a depending stop projection at or adjacent its second end for interferingly engaging the second end edge of the base member bottom to arrest movement of the slide member in the locking direction at the extended position. As a further particular feature of the invention, the slide member also includes a portion, extending between the lateral flanges and its second end (so as to space the latter end away from the flanges), dimensioned to enable the stop projection to be moved manually upward above the second end edge of the base member bottom and thereby to release the slide member for movement in the locking direction beyond the extended position. That is to say, the slide member of the latch of the invention is arranged to flex intermediate its ends so as to disengage the stop projection from the end edge of the base member bottom for movement of the slide member in a direction to expose the upwardly facing surface of the base member bottom.

Advantageously, the biasing means of the latch is a helical spring disposed, between the base member and the slide member, in a recess cooperatively defined by the slide member and the base member bottom, and under compression between opposite ends of the recess respectively formed in the slide member adjacent the first end thereof and fixed in the base member bottom adjacent the second end edge thereof. To fasten the base member to a sash, a headed fastening element such as a screw extends through the base member bottom into the sash with its head positioned to constitute the aforementioned end of the recess fixed in the base member.

Access to the screw head is readily accomplished, for fastening the base member into the sash, by the above-described operation of disengaging the stop projection of the slide member from the end edge of the base member bottom and moving the slide member in the locking direction beyond the extended position so as to expose that portion of the base member bottom in which the screw is located. Thus, the latch can be conveniently assembled by the manufacturer and readily manipulated for mounting by the installer without complete disassembly and without danger of loss of parts.

Further features and advantages of the invention will be apparent from the detailed description hereinbelow set forth, together with the accompanying drawings.

DETAILED DESCRIPTION

Figures 1, 2, 3, 4:
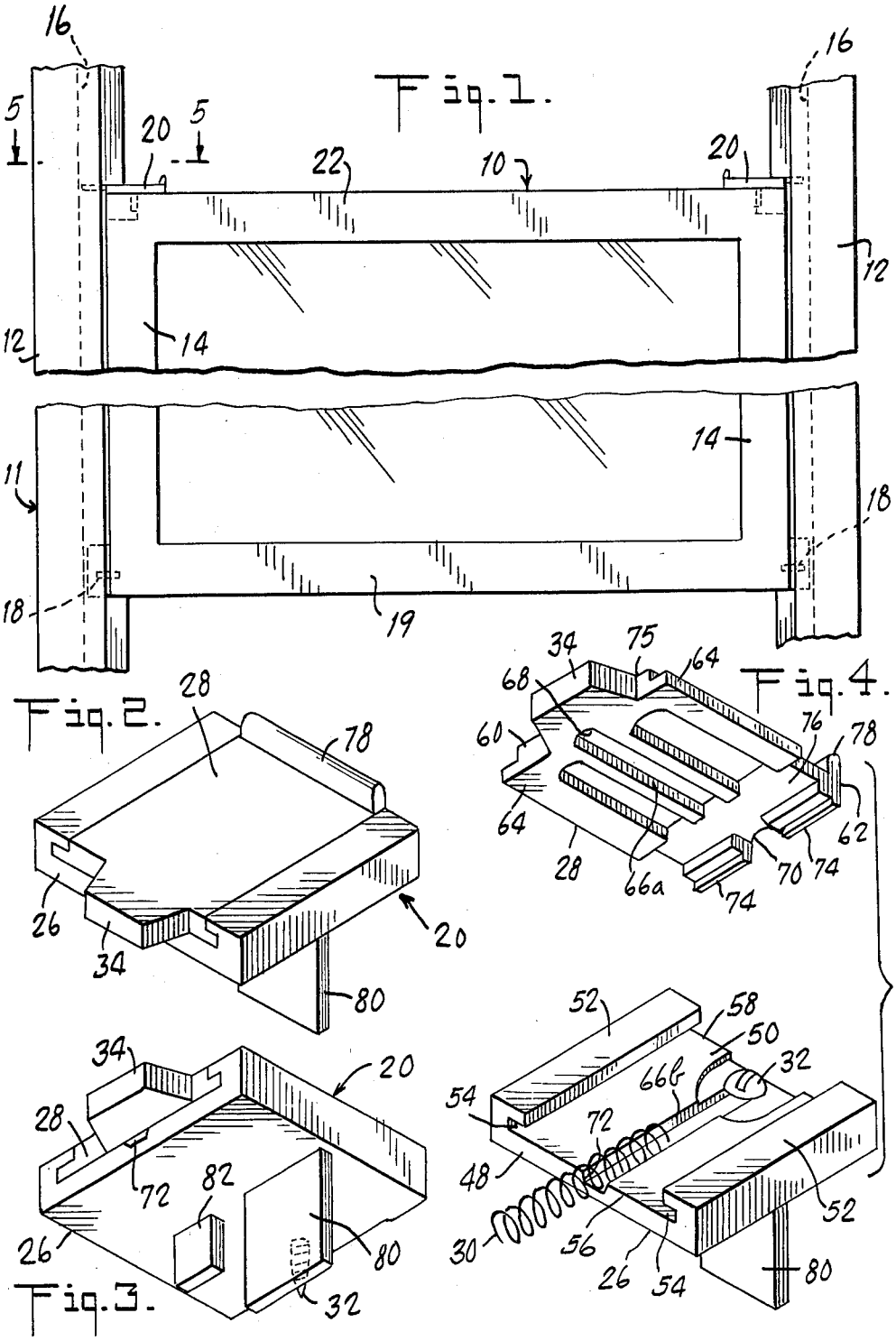
FIG. 1 is a schematic fragmentary front elevational view of a window assembly including two latches embodying the present invention in a particular form.
FIG. 2 is an enlarged perspective view, from above, of a latch as shown in FIG. 1.
FIG. 3 is a perspective view from below of the latch FIG. 2.
FIG. 4 is an exploded perspective view of the latch of FIGS. 2 and 3.
Figure 5:
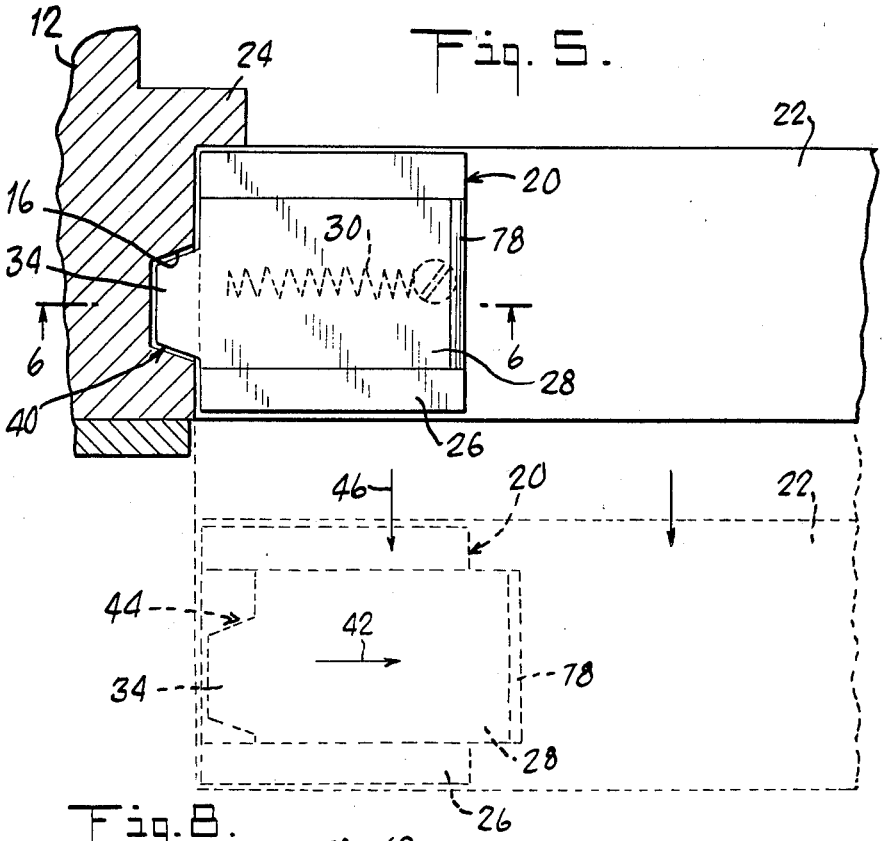
FIG. 5 is an enlarged view taken along the line 5—5 of FIG. 1.

Referring to the drawings, FIGS. 1, 5, 6 and 7 illustrate schematically a window frame assembly including a generally conventional rectangular glazed window sash 10 mounted for vertical sliding movement in a window frame 11 which is in turn fixedly secured in a building wall (not shown). The opposite vertical sides 12 of the window frame (other portions of the frame being omitted from the drawing for simplicity of illustration) respectively engage the opposite sides 14 of the sash, and are respectively provided with recesses 16 extending vertically (in the direction of sash movement) over at least substantially the full height of the frame. The two recesses 16 are disposed to face each other across the space defined between the frame sides 12.

Specifically, the sash is retained in the frame by means of guides 18 mounted on the opposite sides of the sash adjacent the bottom rail 19 thereof so as to project into the two frame recesses 16, and by a pair of latches 20 mounted on the top rail 22 of the sash respectively adjacent the opposite sides of the sash and having portions likewise projecting into the frame recesses 16. The sash is further prevented from outward movement relative to the frame by portions 24 of the frame sides overlying the side edges of the sash on the outer side of the window assembly. The sash is so dimensioned, however, that when the latches 20 are withdrawn from the frame recesses 16, the sash can pivot or tilt inwardly relative to the frame about a horizontal axis coincident with the guides 18, e.g. to enable the outer glass surfaces of the window to be easily cleaned.

Apart from the form and structure of the latches 20, which will be described in detail below, the illustrated window assembly is intended to exemplify a generally conventional type of window having a vertically slidable sash so arranged as to be releasable and tiltable inwardly from the frame. It will be understood that the showing and the foregoing description of this window assembly are set forth merely to provide one specific example of an environment of use for the tilt latch of the present invention, and that the latch of the invention may be incorporated in other and different types of tiltable sash window assemblies.

As best seen in FIGS. 2–4, the latch 20 of the invention, in its illustrated embodiment, comprises a base member 26, a slide member 28, and a helical spring 30 (FIG. 4). The base member 26 is a unitary, integral, injection-molded plastic article mountable on the top rail 22 of the sash 10 by means of a screw 32, and is shaped to define a broad, shallow, upwardly opening and open-ended channel for receiving the slide member 28, which is also a unitary, integral, injection-molded plastic article. The slide member, disposed in the channel of the base member, is shaped and dimensioned to slide endwise in the channel relative to the base member, and has one end shaped to constitute a nose 34 that is insertable in the vertical recess 16 of a side 12 of the window frame 11, i.e. when the latch 20 is mounted on the top rail of the sash adjacent that side of the frame.

The spring 30 constitutes a biasing means acting between the base member and the slide member for urging the slide member (relative to the base member) in what is herein termed the locking direction, viz. toward the extended position in which the slide member nose 34 is fully received in the frame recess 16 to lock the sash 10 against tilting. This extended position is shown in solid lines at 40 in FIG. 5. For release of the sash from the frame (to permit tilting of the frame), the slide member 28 is slidable manually against the force of the biasing spring, i.e. in the direction represented by arrow 42 in FIG. 5 (opposed to the locking direction), to the retracted position shown in broken lines at 44 in FIG. 5, in which the nose 34 is completely clear of the frame side 12 so as to enable the sash to be tilted. The direction of tilting movement of the sash is indicated by arrows 46 of FIG. 5.

More particularly, the base member 26 includes a bottom portion 48 with a broad upwardly facing surface 50 and two spaced parallel side portions 52 projecting upwardly from opposite sides of the bottom portion along the length of the base member so as to define, with the bottom portion, the aforementioned shallow channel for receiving the slide member. Facing parallel grooves 54 are respectively formed in the two side portions 52; both grooves 54 extend for the full length of the channel, i.e. from one open end thereof to the other. The bottom portion 48 has a first end edge 56 positioned to face the adjacent side of a window frame when the base member is mounted on the top corner of a sash, and a second end edge 58 at the opposite extremity of the base member, both edges 56 and 58 extending transversely of the direction of sliding movement of the slide member.

The slide member 28 has opposed first and second ends respectively designated by reference numerals 60 and 62 and respectively located adjacent the first and second end edges of the bottom portion of the base member when the slide member is disposed in the channel of the base member, the nose 34 being formed at the first end 60 of the slide member. In addition, the slide member has two opposed side flanges 64 extending from the first end 60 toward the second end 62 of the slide member; these flanges 64 are located and dimensioned to be respectively received in the two grooves 54 of the base member when the slide member is disposed in the base member channel, for retaining the slide member in the channel and permitting guided endwise sliding movement of the slide member. It will be understood that the side portions 52 of the base member and the lateral flanges 64 of the slide member cooperatively restrain the slide member against vertical or lateral displacement out of the channel.

Figure 6:
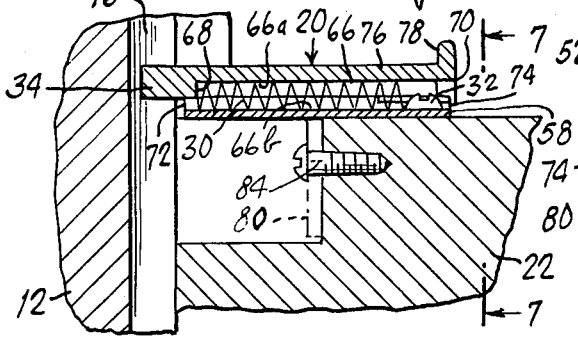
FIG. 6 is a sectional elevational view taken along the line 6—6 of FIG. 5.
Figure 7:
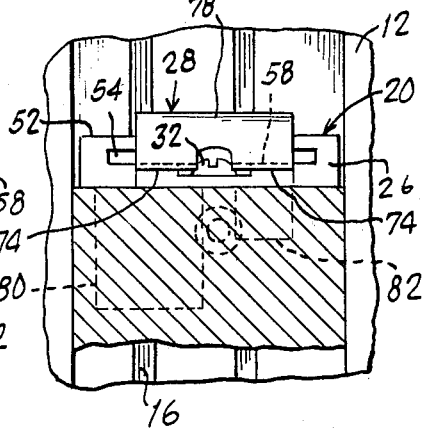
FIG. 7 is an end elevational view taken along the line 7—7 of FIG. 6.

The spring 30 is disposed, between the base member and the slide member, in a recess 66 cooperatively defined by portions **66*a* of the under surface of the slide member and 66*b* of the upwardly facing surface 50 of the base member, and (like the spring) axially aligned with the direction of sliding movement of the slide member. As best seen in FIG. 6, the spring is under compression between one end 68 of the recess, formed in the slide member adjacent the first end thereof, and the head of the screw 32, which is fixed in the base member bottom portion adjacent the second end edge thereof and is positioned to constitute the opposite end of the recess. To facilitate assembly and disassembly of the latch, the recess portion 66*a* of the slide member opens at 70 through the second end 62 of the slide member, while the recess portion 66b of the base member opens at 72 through the first end edge 56** of the base member.

In accordance with the present invention, the slide member 28 has a depending stop projection, in the form of a ledge 74 extending transversely of the direction of a slide member movement, at its second end 62. This ledge 74 is positioned to interferingly engage the second end edge 58 of the base member bottom portion 48 when the slide member is in the aforementioned extended position, as best seen in FIG. 6, and thereby to arrest movement of the slide member in the locking direction at the extended position. Thus, the ledge 74 and the biasing force of the spring 30 cooperatively retain the slide member within the base member channel and hold it against displacement (in either endwise direction) out of the extended position in the absence of manually applied force.

Further in accordance with the invention, the slide member 28 may be considered as made up of two portions 75 and 76 respectively extending toward each other from the first and second ends 60 and 62 of the slide member and meeting at an intermediate locality thereof, it being understood that portions 75 and 76 are integral with each other and together constitute the slide member body. The portion 75, which includes the first end of the slide member, bears the lateral flanges 64. These flanges do not continue onto the portion 76, which extends between the first, flange-bearing portion 75 of the slide member and the second end 62 of the slide member so as to space the latter end away from the flanges. The portion 76 is dimensioned to enable the stop projection or ledge 74 to be moved manually upwardly above the second end edge 58 of the base member bottom portion and thereby to release the slide member for movement in the locking direction beyond the aforementioned extended position.

More particularly, the slide member portion 76, lacking the flanges, has a width narrower than the minimum transverse distance between the side portions 52 of the base member, and is sufficiently thin to be resiliently deformable by applied manual force, although in the absence of such applied force it is stiff and indeed substantially rigid. This construction of the portion 76, as stated, enables the slide member to flex for release from the extended position shown in FIG. 6 and for movement beyond the extended position in the locking direction (arrow 77), to or beyond the position shown in FIG. 8.

Figure 8:
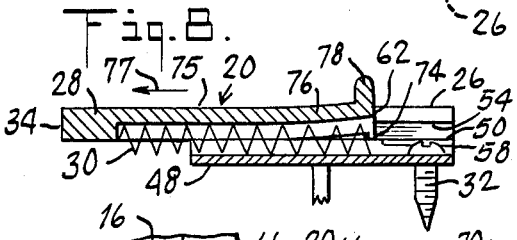
FIG. 8 is a sectional view of the latch, similar to FIG. 6, but illustrating the position to which the slide member can be moved to expose the screw head for fastening.

As will be apparent from FIG. 8, once the ledge 74 has been lifted above base member edge 58 by flexing of the slide member, and the slide member has been moved beyond the extended position in the locking direction, the slide member ledge 74 rides along the upper surface 50 of the base member bottom portion. If, however, the slide member is returned in the opposite direction (arrow 42, FIG. 5) to the extended position, the resiliency of slide member portion 76 restores the ledge 74 to its original level, viz. the level at which the ledge interferingly engages the base member edge 58.

It will be appreciated that the material of which the slide member is made is selected such that the portion 76, having the described dimensions, will be sufficiently resiliently deformable to enable performance of the releasing operation described above, and to otherwise maintain the ledge 74 at the level for interfering engagement with the base member edge.

In the illustrated embodiment, the slide member additionally has a manually engageable upward projection 78 at its second end 62 to facilitate manual sliding movement of the slide member in the direction of arrow 42 (opposed to the locking direction) for release of the sash from the frame. Also, the base member 26 is shown as provided with downward projections 80 and 82 for use in stablizing and/or securing the base member on a sash. The arrangement of the base member in this respect may be designed to accommodate the particular configuration of window sash on which the latch is to be mounted. If desired, one or more screws 84 may extend into the sash through the projections 80 and/or 82 to contribute to secure fastening of the latch.

The dimensions of the channel defined by the base member 26 are uniform from end to end. Hence the latch 20 can be assembled by inserting the second end 62 of the slide member into the open end of the base member channel at the first end edge 56 of the base member bottom portion, and sliding the slide member in the direction indicated by arrow 42 (FIG. 5) until the ledge 74 passes the second end edge 58 of the base member. At this point, the ledge 74 drops down to interferingly engage the base member end edge 58. The spring 30 is conveniently prepositioned in the recess portion 66a of the slide member, i.e. before the slide member is inserted in the base member, and held manually in that position until it is adequately supported by the recess portion 66b of the base member. The screw 32 may be positioned in the base member at this time, i.e. before the slide member reaches the position represented in FIG. 6.

The latch can be assembled in the described manner by the manufacturer and supplied in assembled condition to the installer. To mount the latch on a window sash, the installer simply manually flexes the portion 76 of the slide member to lift the ledge 74 out of engagement with the base member end edge, and slides the slide member in the locking direction sufficiently to expose the head of the screw 32, this being the position illustrated in FIG. 8. At the last-mentioned position, the slide member is still held in the base member owing to the relatively tight fit of the flanges 64 in the grooves 54; thus there is no danger of disengagement and possible loss of latch parts. An additional advantage of the invention is that it enables the provision of latches which are advantageously smaller in size than are conventional latches used for the same purpose.

It is to be understood that the invention is not limited to the features and embodiments hereinabove specifically set forth but may be carried out in other ways without departure from its spirit.

I claim:

1. A tilt latch for a window sash, comprising (a) a base member mountable on a sash, having a bottom with an upwardly facing surface and opposed first and second end edges, and spaced parallel sides projecting upwardly from the bottom to define therewith an upwardly opening, open-ended channel, facing parallel grooves being respectively formed in said sides;

(b) a slide member disposed in said channel for endwise sliding movement relative to the base member, and having opposed first and second ends respectively adjacent the first and second end edges of the bottom of the base member, and opposed side flanges extending from the first end toward the second end and respectively received in said grooves, the slide member further having, at its first end, a nose receivable in a window frame to prevent tilting of the sash relative to the frame; and (c) resilient biasing means acting between the base member and the slide member for urging the slide member in a locking direction toward an extended position in which the nose projects beyond the first end of the base member so as to be received in the window frame;

(d) said slide member including a depending stop projection at the second end of the slide member for interferingly engaging the second end edge of the base member bottom to arrest movement of the slide member in the locking direction at the extended position, and (e) said slide member further including a portion, extending between the lateral flanges and said second end so as to space the second end away from the flanges, and disposed to enable the stop projection to be moved manually upward above the second end edge of the base member bottom and thereby to release the slide member for movement in the locking direction beyond the extended position.

2. A tilt latch as defined in claim 1, wherein said biasing means comprises a helical spring disposed, between the base member and the slide member, in a recess cooperatively defined by the slide member and the base member bottom, and under compression between opposite ends of the recess respectively formed in the slide member adjacent the first end thereof and fixed in the base member bottom adjacent the second end edge thereof.

3. A tilt latch as defined in claim 2, further including means for fastening the base member to a sash, said fastening means comprising a screw extending through the base member bottom so as to be drivable into the sash and having a head positioned to constitute said end of said recess fixed in the base member, said head being accessible, for fastening the base member to the sash, by movement of the slide member in the locking direction beyond the extended position without disengagement of the flanges from the grooves.

4. A tilt latch as defined in claim 2, wherein the base member and the slide member are cooperatively shaped to permit assembly of the latch by insertion of the second end of the slide member into the open end of the channel adjacent the first end edge of the base member bottom and subsequent sliding movement of the slide member relative to the base member in a direction opposed to said locking direction.

5. A tilt latch as defined in claim 4, wherein the base member is an integral molded plastic body, and the slide member is an integral molded body of a plastic sufficiently resiliently deformable to enable upward movement of the stop projection as aforesaid upon application thereto of appropriately directed manual force while otherwise maintaining the stop projection at a level for interfering engagement with the second end edge of the base member bottom.

6. A tilt latch as defined in claim 5, wherein the slide member has a manually engageable upward projection at its second end edge to facilitate manual sliding movement of the slide member in a direction opposed to the locking direction for release of the sash from the frame.

7. A tilt latch as defined in claim 6, wherein the stop projection is a downwardly projecting ledge portion of the slide member extending transversely of the direction of slide member movement.

* * * * *